US010638828B2

(12) United States Patent
Wang et al.

(10) Patent No.: US 10,638,828 B2
(45) Date of Patent: May 5, 2020

(54) ADJUSTABLE CONTAINER CARRYING STRAP STRUCTURE

(71) Applicant: WLD PRODUCTION CO., LTD., New Taipei (TW)

(72) Inventors: Chun-Ming Wang, New Taipei (TW); Lee Lin, New Taipei (TW)

(73) Assignee: WLD PRODUCTION CO., LTD., New Taipei (TW)

( * ) Notice: Subject to any disclaimer, the term of this patent is extended or adjusted under 35 U.S.C. 154(b) by 0 days.

(21) Appl. No.: 16/458,666

(22) Filed: Jul. 1, 2019

(65) Prior Publication Data

US 2020/0008563 A1 Jan. 9, 2020

(30) Foreign Application Priority Data

Jul. 3, 2018 (TW) ..... 107209012 U

(51) Int. Cl.
*A45F 5/10* (2006.01)

(52) U.S. Cl.
CPC ..... *A45F 5/1026* (2013.01); *A45F 2005/108* (2013.01); *A45F 2005/1013* (2013.01)

(58) Field of Classification Search
CPC .. A45F 5/10; A45F 5/1026; A45F 2005/1033; A45F 2005/108; A45F 2005/1013
USPC ..... 294/170
See application file for complete search history.

(56) References Cited

U.S. PATENT DOCUMENTS 1,208,728 A * 12/1916 Bartlett et al. ..... A45F 5/00 224/148.6
2,090,979 A * 8/1937 Johansen ..... B65D 23/108 294/27.1
4,756,567 A * 7/1988 Nilson ..... B66C 1/12 294/119.2
4,804,218 A * 2/1989 Hilliard ..... B63C 11/22 294/157
D379,119 S * 5/1997 Wolfe ..... D3/229
8,061,750 B1 * 11/2011 Hamilton ..... A45C 13/30 294/149

* cited by examiner

*Primary Examiner* — Stephen A Vu
(74) *Attorney, Agent, or Firm* — Muncy, Geissler, Olds & Lowe, P.C.

(57) ABSTRACT

An adjustable container carrying strap structure includes a strip-shaped carrying strap and a container sleeving assembly. The strip-shaped carrying strap includes a first end, a second end, and a carrying strap body. The container sleeving assembly includes two sleeve ropes and an adjusting element, where each sleeve rope includes a first rope end, a second rope end, and a rope body, the first rope end of each sleeve rope is connected to the first end, the second rope end of each sleeve rope is connected to the second end, and the adjusting element is assembled on the two rope bodies of the two sleeve ropes, so that the adjusting element, the two rope bodies, and the first end of the strip-shaped carrying strap encircle a container sleeving hole. The adjusting element can slide relatively along the two rope bodies so as to adjust the size of the container sleeving hole.

15 Claims, 9 Drawing Sheets

ADJUSTABLE CONTAINER CARRYING STRAP STRUCTURE

CROSS-REFERENCE TO RELATED APPLICATION

This non-provisional application claims priority under 35 U.S.C. § 119(a) to Patent Application No. 107209012 in Taiwan, R.O.C. on Jul. 3, 2018, the entire contents of which are hereby incorporated by reference.

BACKGROUND

Technical Field

The instant disclosure relates to a carrying strap structure, and in particular, to an adjustable container carrying strap structure.

Related Art

In daily life, people often use containers to hold articles. For example, when a consumer buys a take-away food in a store, the store often uses a disposable container to hold the take-away food. For example, when the consumer buys a soup, the store uses a plastic bowl or a paper bowl to hold the soup; or when the consumer buys a latte, the store uses a paper cup to hold the latte.

However, these containers are very inconvenient to carry. For example, the consumer needs to hold the periphery of the container or grasp the cover of the container by the palm, but these manners can easily cause the container or the cover to fall off in the carrying process, and the consumer cannot grasp the container by hand when the container has a large volume or high-temperature contents are contained in the container. Therefore, most stores provide shopping bags such as plastic bags or paper bags for consumers to use. Nonetheless, the excessive use of the shopping bags would not only aggravate the waste of resources but also increase our carbon footprint.

SUMMARY

In view of this, in an embodiment, an adjustable container carrying strap structure is provided and includes a strip-shaped carrying strap and a container sleeving assembly. The strip-shaped carrying strap includes a first end and a second end which are opposite and a carrying strap body between the first end and the second end. The container sleeving assembly includes two sleeve ropes and an adjusting element, where each sleeve rope includes a first rope end and a second rope end which are opposite and a rope body between the first rope end and the second rope end, the first rope end of each sleeve rope is connected to the first end of the strip-shaped carrying strap, the second rope end of each sleeve rope is connected to the second end of the strip-shaped carrying strap, and the adjusting element is assembled on the two rope bodies of the two sleeve ropes, so that the adjusting element, the two rope bodies, and the first end of the strip-shaped carrying strap encircle a container sleeving hole. The adjusting element can selectively slide relatively along the two rope bodies so as to adjust the size of the container sleeving hole.

Thereby, according to the embodiment of the adjustable container carrying strap structure, the adjusting element can slide relatively along the two rope bodies to enable the container sleeving hole to be sleeved on containers with different sizes and fastened between the two rope bodies, so that the container can be carried by means of the carrying strap body, thereby achieving the advantages of reducing the use of shopping bags, further realizing environmental protection, saving resources and the like. In addition, the two sleeve ropes are connected between the ends of the strip-shaped carrying strap to form a ring, so that no matter which size of a container the adjustable container carrying strap structure is used for, when the container is carried, the container can be kept upright and not inclined so as to effectively prevent articles contained inside the container from dumping or being poured out.

DETAILED DESCRIPTION

Figure 1:
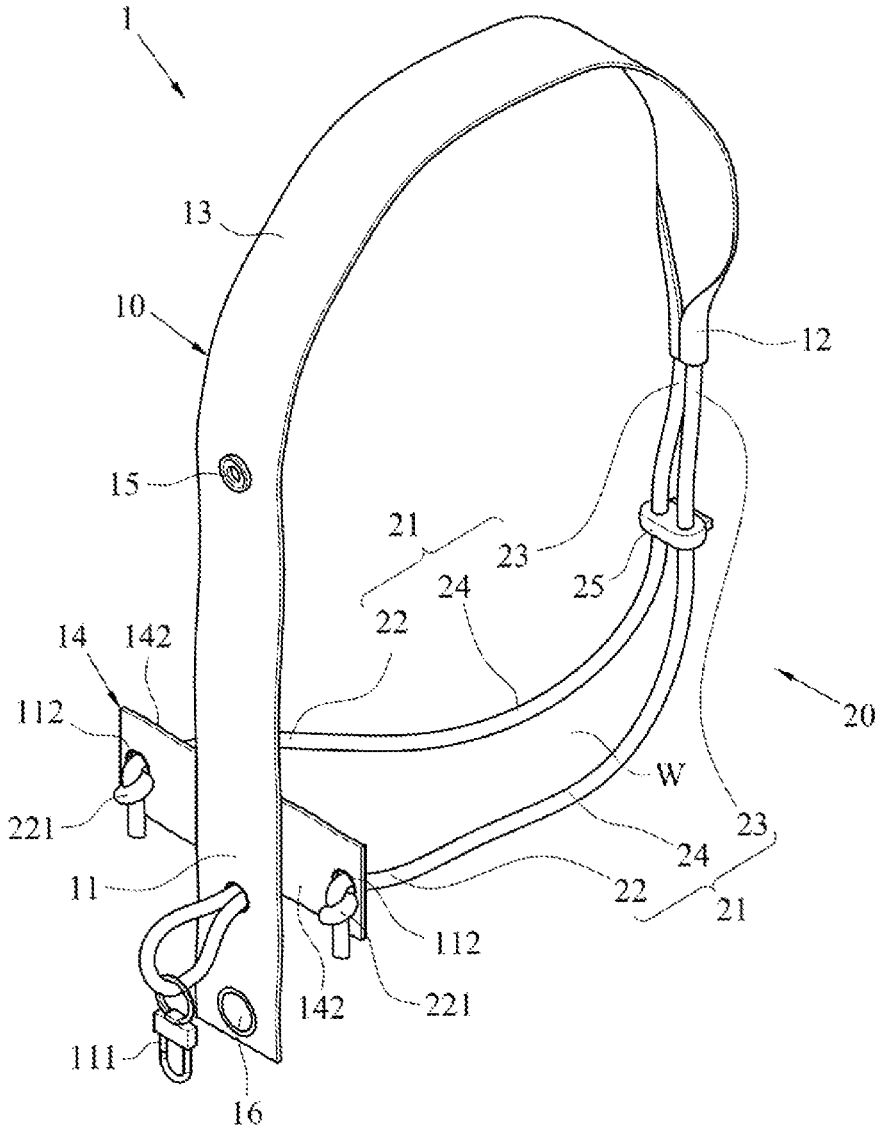
FIG. 1 illustrates a three-dimensional diagram of an embodiment of an adjustable container carrying strap structure of the instant disclosure.

FIG. 1 is a three-dimensional diagram of an embodiment of an adjustable container carrying strap structure of the instant disclosure. As shown in FIG. 1, in this embodiment, an adjustable container carrying strap structure 1 includes a strip-shaped carrying strap 10 and a container sleeving assembly 20, where the adjustable container carrying strap structure 1 can sleeve bodies of various containers (such as a PET bottle, a beverage cup, a food container, a packing container, or other appliances capable of containing articles) by means of the container sleeving assembly 20, and the containers can be carried by means of the strip-shaped carrying strap 10.

As shown in FIG. 1, in this embodiment, the strip-shaped carrying strap 10 is a strip-shaped strap body with a preset width and a preset length and includes a first end 11 and a second end 12 which are opposite and a carrying strap body 13 between the first end 11 and the second end 12. For example, the width of the strip-shaped carrying strap 10 can be 1 cm, 2 cm, 3 cm, or 5 cm, and the length of the strip-shaped carrying strap 10 can be 20 cm, 30 cm, or 40 cm. However, in fact, the length and width of the strip-shaped carrying strap 10 can be adjusted according to actual needs. The above lengths and widths are examples only and are not intended to limit the instant disclosure. In some embodiments, the strip-shaped carrying strap 10 is a strap body with flexibility. For example, the strip-shaped carrying strap 10 can be a braided strap, a belt, a ribbon, or a plastic tape. Alternatively, the strip-shaped carrying strap 10 can be a flat strap body and also can be a rope body with flexibility, such as a cotton rope, a plastic rope, a hemp rope, a nylon rope, or an industrial rope.

As shown in FIG. 1, the container sleeving assembly 20 includes two sleeve ropes 21 and an adjusting element 25, where each sleeve rope 21 includes a first rope end 22 and a second rope end 23 which are opposite and a rope body 24 between the first rope end 22 and the second rope end 23. In some embodiments, each sleeve rope 21 can be a nylon rope, a hemp rope, a cotton rope, a plastic rope, or an industrial rope.

As shown in FIG. 1, the first rope end 22 of each sleeve rope 21 is connected to the first end 11 of the strip-shaped carrying strap 10, and the second rope end 23 of each sleeve rope 21 is connected to the second end 12 of the strip-shaped carrying strap 10. In other words, the two sleeve ropes 21 are connected between the two ends of the strip-shaped carrying strap 10 to enable the two sleeve ropes 21 and the strip-shaped carrying strap 10 to form a closed ring, and the two sleeve ropes 21 can open relatively or abut against each other.

In some embodiments, each sleeve rope 21 can be connected between the two ends of the strip-shaped carrying strap 10 by means of many manners. For example, in the embodiment of FIG. 1, the second rope end 23 of each sleeve rope 21 is fixedly arranged at (such as in manners of sticking, knotting, suturing, binding, hot melting and the like or by using a fastener) the second end 12 of the strip-shaped carrying strap 10. The first end 11 of the strip-shaped carrying strap 10 is provided with two through holes 112 (the two through holes 112 are formed in the strap body extended from the first end 11 and also can be directly formed in the first end 11) and the two first rope ends 22 of the two sleeve ropes 21 respectively penetrate through the two through holes 112. The first rope end 22 of each sleeve rope 21 is provided with a stopping element 221, and the size of the stopping element 221 is greater than the size of each through hole 112, so that the first rope end 22 of each sleeve rope 21 can move relative to the through hole 112 to facilitate coiling, and the stopping element 221 can prevent the first rope end 22 of each sleeve rope 21 from separating so as to achieve a limiting effect.

Figure 4:
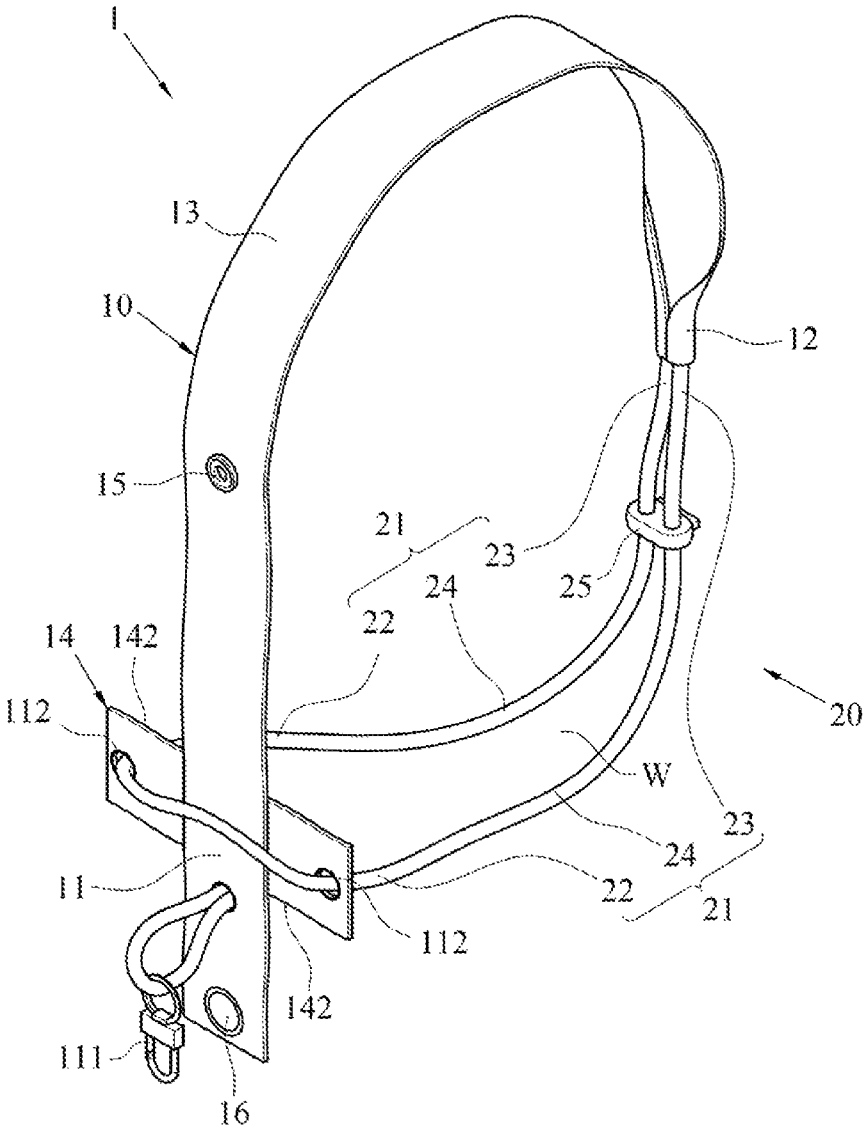
FIG. 4 illustrates a three-dimensional diagram of another embodiment of the adjustable container carrying strap structure of the instant disclosure.

However, the above embodiment is only an example. In fact, the first rope end 22 of each sleeve rope 21 can also be fixedly arranged at (such as in manners of sticking, knotting, suturing, binding, hot melting and the like or by using a fastener) the first end 11 of the strip-shaped carrying strap 10. Alternatively, in another embodiment, the first rope end 22 and the second rope end 23 of each sleeve rope 21 are detachably connected to (such as in manners of locking, fastening and the like) the first end 11 and the second end 12 of the strip-shaped carrying strap 10 respectively, so that a user can replace different strip-shaped carrying straps 10 or sleeve ropes 21 (such as different models or colors) to obtain different shapes. In addition, when the strip-shaped carrying strap 10 or the sleeve rope 21 is damaged, the user also can partially replace the strip-shaped carrying strap 10 or the sleeve rope 21 and does not need to additionally purchase a brand-new adjustable container carrying strap structure 1, thereby achieving the effect of saving costs. Alternatively, as shown in FIG. 4, the two first rope ends 22 of the two sleeve ropes 21 can also be integrally connected, and in other words, the two sleeve ropes 21 can be formed in a manner that two ends of a rope body respectively penetrate through the two through holes 112 of the first end 11 and then are connected to the second end 12 of the strip-shaped carrying strap 10.

As shown in FIG. 1, in this embodiment, the stopping element 221 of the first rope end 22 of each sleeve rope 21 is a rope knot, and in other words, each stopping element 221 is integrally formed by knotting the first rope end 22 of each sleeve rope 21, so that components for stopping do not need to be additionally arranged so as to achieve the advantages of lowering the costs and simplifying the manufacturing process. However, this embodiment is not limited thereto. In other embodiments, the stopping element 221 can also be an additionally arranged component. For example, in the embodiment of FIG. 6, each stopping element 221' is a chock block and is fixed at the first rope end 22 of each sleeve rope 21.

As shown in FIG. 1, the adjusting element 25 of the container sleeving assembly 20 is assembled on the two rope bodies 24 of the two sleeve ropes 21, so that the adjusting element 25, the two rope bodies 24, and the first end 11 of the strip-shaped carrying strap 10 encircle a container sleeving hole W. The adjusting element 25 can selectively slide relatively along the two rope bodies 24 so as to adjust the size of the container sleeving hole W. In this embodiment, the adjusting element 25 is a double-hole type rope buckle but is not limited thereto, and the adjusting element 25 can also be a single-hole type rope buckle or other movable fasteners.

Figure 2:
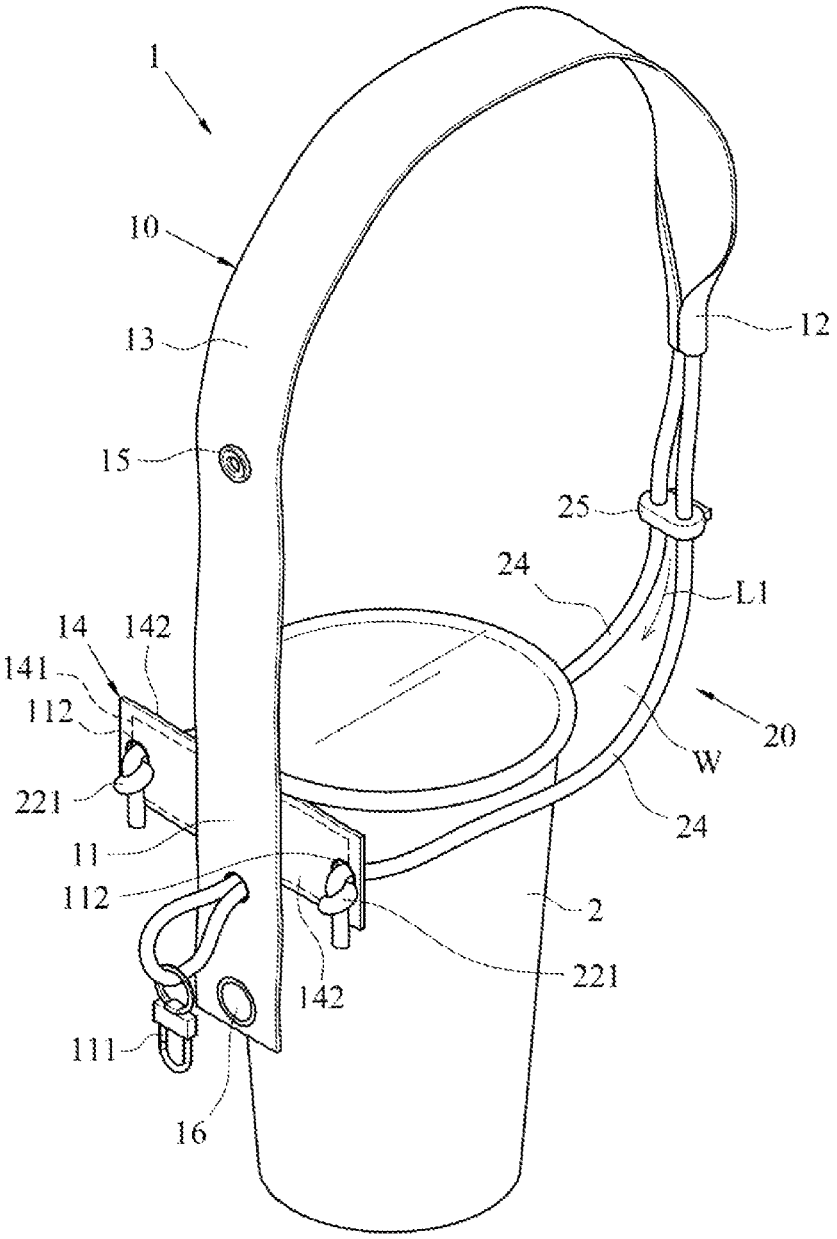
FIG. 2 illustrates a schematic use diagram of the embodiment of the adjustable container carrying strap structure of the instant disclosure.
Figure 3:
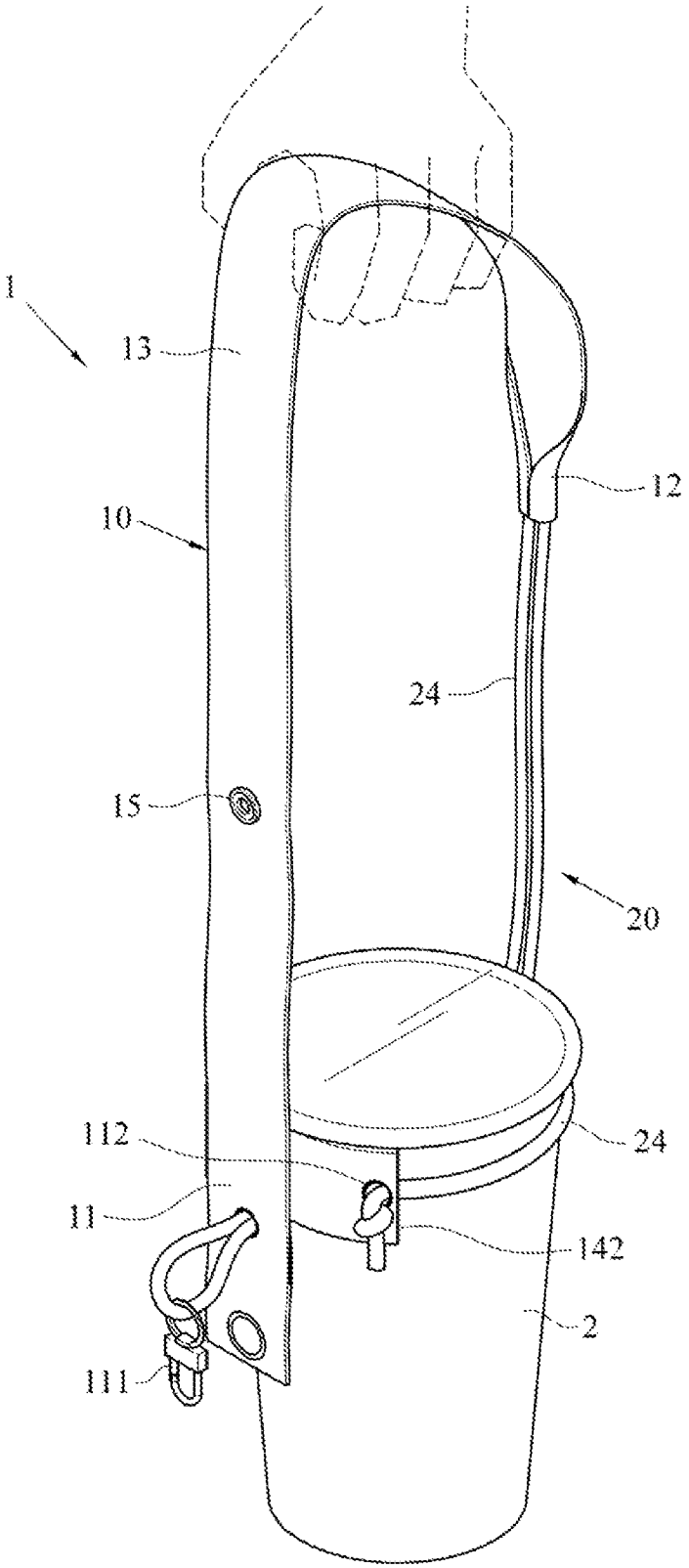
FIG. 3 illustrates a schematic carrying diagram of the embodiment of the adjustable container carrying strap structure of the instant disclosure.

In use of the adjustable container carrying strap structure 1 according to the embodiment of the instant disclosure, as shown in FIG. 2, the user firstly can first control the adjusting element 25 to slide relatively along the two rope bodies 24 so as to adjust the size of the container sleeving hole W to be greater than the size of a container 2 (a cup body herein), then can sleeve the container 2 into the container sleeving hole W to enable the two rope bodies 24 of the two sleeve ropes 21 to be sleeved outside the body of the container 2, and finally can control the adjusting element 25 to slide relatively along the two rope bodies 24 towards the container 2 (as shown by arrow L1) so as to gradually reduce the size of the container sleeving hole W until the adjusting element 25 abuts against the body of the container 2, so that the two rope bodies 24 can be fastened around the container 2. Therefore, as shown in FIG. 3, the user can carry the container 2 by means of the carrying strap body 13 of the strip-shaped carrying strap 10 so as to achieve the advantages of reducing the use of shopping bags, further realizing environmental protection, saving resources and the like. Further, the adjustable container carrying strap structure 1 according to the embodiment of the instant disclosure has a small volume and is easy to fold, thereby facilitating the carrying and increasing the use rate and convenience.

In addition to the above advantages, in the embodiment of the instant disclosure, the two sleeve ropes 21 are connected between the ends of the strip-shaped carrying strap 10 to form a closed ring, so that no matter which size of a container 2 the adjustable container carrying strap structure 1 is used for, when the container 2 is carried, the container 2 can be kept upright and not inclined so as to effectively prevent articles contained inside the container 2 from dumping or being poured out. For example, as shown in FIG. 3, when the container 2 to which the adjustable container carrying strap structure 1 is applied is smaller, the residual sections, which are not sleeved on the container 2, of the two rope bodies 24 are longer, so that the user can hold the partial region, near the second end 12, of the carrying strap body 13 to average the lengths of the two sides of the holding part so as to prevent the container 2 from inclining; and when the container 2 to which the adjustable container carrying strap structure 1 is applied is larger, the residual sections, which are not sleeved on the container 2, of the two rope bodies 24 are shorter, so that the user can hold the middle region or the partial region, near the first end 11, of the carrying strap body 13 to average the lengths of the two sides of the holding part so as to prevent the container 2 from inclining. The drawing of this embodiment is omitted. In conclusion, when the adjustable container carrying strap structure 1 is used for containers 2 with different sizes, the user can hold different parts of the carrying strap body 13 to achieve a balance effect so as to keep the container 2 upright and not inclined.

As shown in FIG. 3, in an embodiment, preferably, the length of the strip-shaped carrying strap 10 is greater than the length of each sleeve rope 21, so that no matter which size of a container 2 the adjustable container carrying strap structure 1 is used for, the user can carry the container 2 by means of the strip-shaped carrying strap 10. However, this embodiment is not limited thereto.

As shown in FIG. 3, in an embodiment, preferably, the width of the strip-shaped carrying strap 10 is greater than the width of each sleeve rope 21 to increase the contact area when the strip-shaped carrying strap 10 is carried, thereby improving the comfort level. However, this embodiment is not limited thereto.

As shown in FIG. 2 and FIG. 3, in an embodiment, the first end 11 of the strip-shaped carrying strap 10 can laterally extends to form a reinforcing element 14. Herein, the reinforcing element 14 includes two strap-shaped bodies 142, and each strap-shaped body 142 can be a strap body with flexibility, such as a braided strap, a belt, a ribbon, or a plastic tape. In other embodiments, the reinforcing element 14 can also be a hard sheet. This embodiment is not limited thereto.

As shown in FIG. 2 and FIG. 3, the two strap-shaped bodies 142 respectively extend from two opposite sides of the first end 11 of the strip-shaped carrying strap 10, and the two first rope ends 22 of the two sleeve ropes 21 can be connected to the two strap-shaped bodies 142 respectively. For example, in this embodiment, the two through holes 112 in the first end 11 of the strip-shaped carrying strap 10 are formed in the two strap-shaped bodies 142, and the two first rope ends 22 of the two sleeve ropes 21 respectively penetrate through the two through holes 112. Therefore, when the two rope bodies 24 are fastened on the body of the container 2, the two strap-shaped bodies 142 are tensioned by the two rope bodies 24 so as to be in contact with the surface of the container 2, thereby obtaining a better support effect to prevent the adjustable container carrying strap structure 1 from easily moving or upwards separating.

In an embodiment, the inner side of the reinforcing element 14 can be further provided with an anti-slide structure 141. For example, as shown in FIG. 2, the anti-slide structure 141 is arranged at the inner sides of the two strap-shaped bodies 142. The anti-slide structure 141 can be an anti-slide pad, anti-slide rubber or the like to strengthen the adhesive force of the reinforcing element 14 against the surface of the container 2, thereby further preventing the adjustable container carrying strap structure 1 from easily moving or upwards separating.

Figure 5:
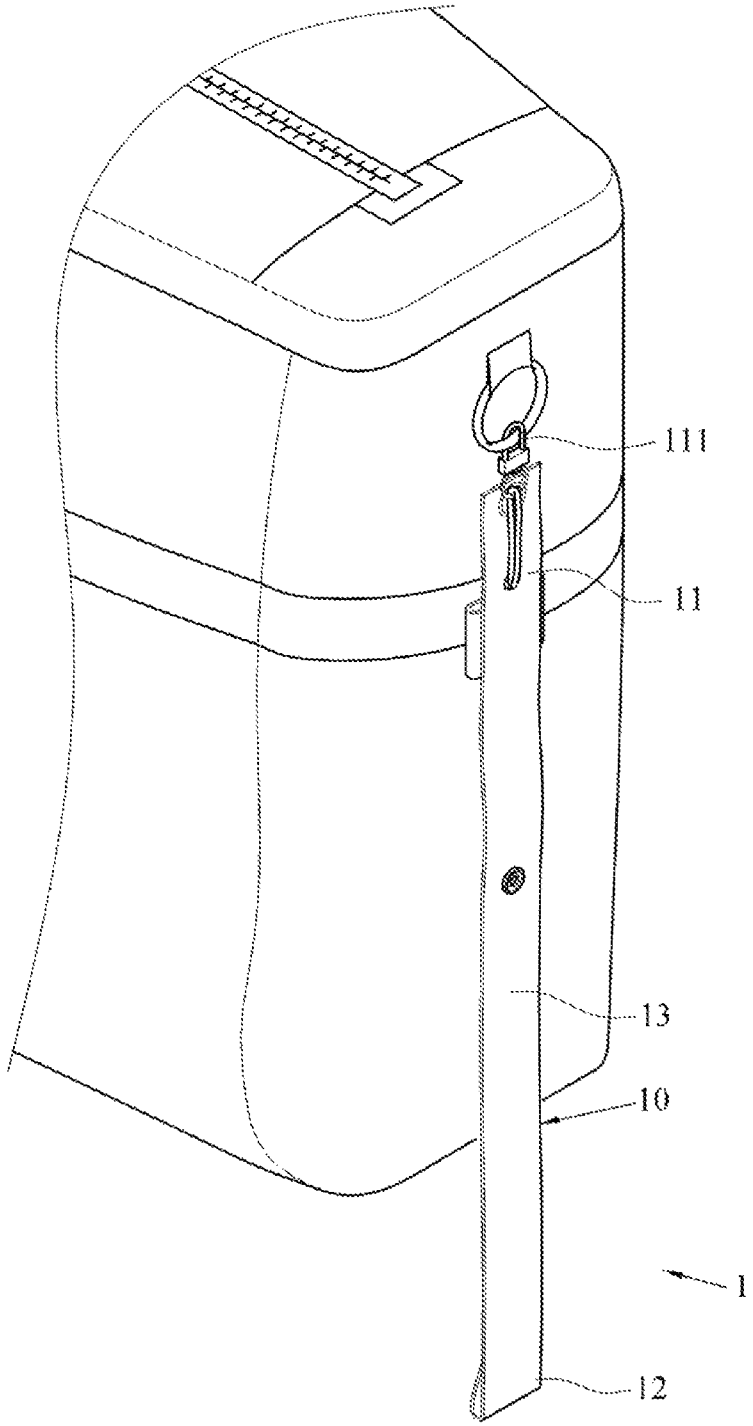
FIG. 5 illustrates a schematic hanging diagram of an embodiment of the adjustable container carrying strap structure of the instant disclosure.

As shown in FIG. 5, in an embodiment, the first end 11 of the strip-shaped carrying strap 10 can be further provided with a hanger 111 (such as a hook or a hanging ring), so that the adjustable container carrying strap structure 1 can be hung on a carry-on article (such as a knapsack) or clothes of the user by means of the hanger 111 when being carried, thereby increasing the carrying convenience.

Figure 6:
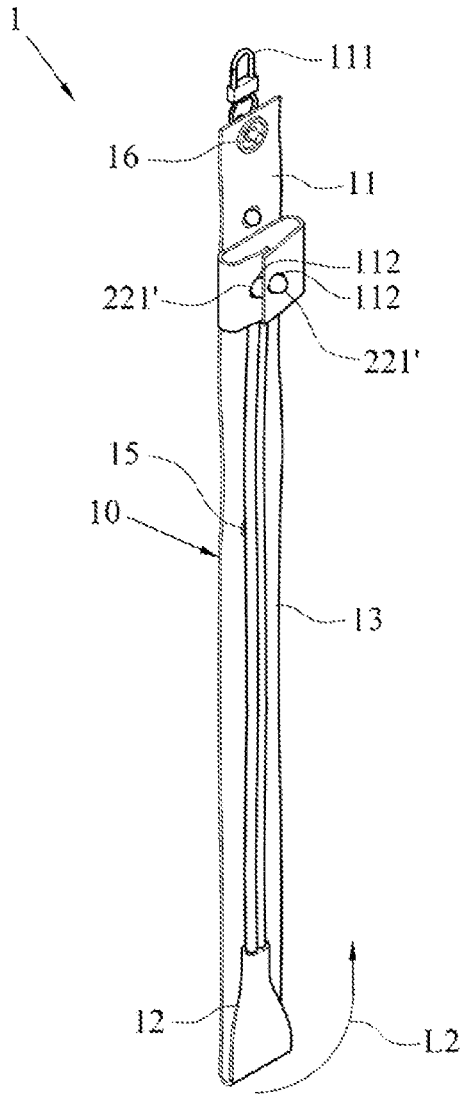
FIG. 6 illustrates a schematic winding diagram of the embodiment of the adjustable container carrying strap structure of the instant disclosure.
Figure 7:
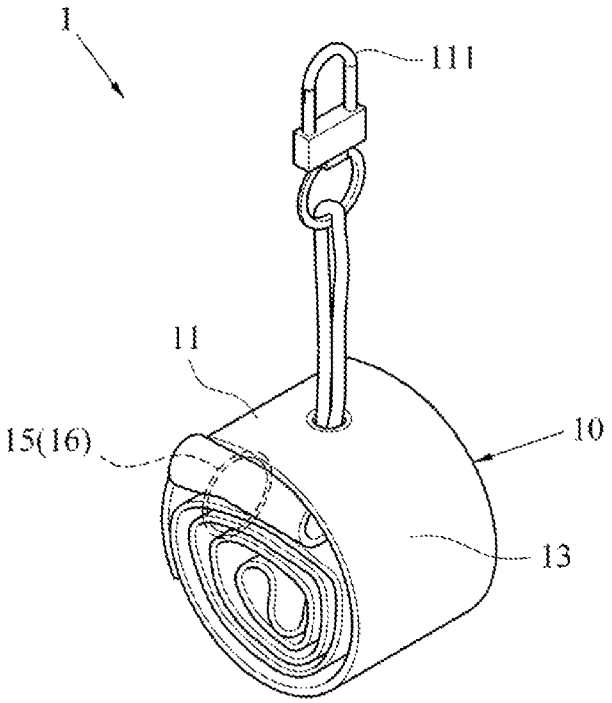
FIG. 7 illustrates a schematic coiling diagram of the embodiment of the adjustable container carrying strap structure of the instant disclosure.

As shown in FIG. 6 and FIG. 7, in an embodiment, one side of the carrying strap body 13 of the strip-shaped carrying strap 10 can be provided with a first assembly part 15, and the first end 11 of the strip-shaped carrying strap 10 is provided with a second assembly part 16 corresponding to the first assembly part 15. Therefore, after the adjustable container carrying strap structure 1 is folded or coiled, the first assembly part 15 can move to be close to the second assembly part 16 and is assembled on the second assembly part 16 so as to fix the folded or coiled state, thereby reducing the volume of the adjustable container carrying strap structure 1 and further facilitating the carrying.

As shown in FIG. 1 and FIG. 6, in this embodiment, the first assembly part 15 and the second assembly part 16 are male and female buckles corresponding to each other, the adjustable container carrying strap structure 1 can be coiled towards a coiling direction (as shown by arrow L2 in FIG. 6), and the first assembly part 15 is adjacent to the first end 11 of the strip-shaped carrying strap 10. Therefore, as shown in FIG. 7, when the adjustable container carrying strap structure 1 is coiled into a cylinder shape, the first assembly part 15 and the second assembly part 16 can be fastened to each other to achieve a fixing effect so as to greatly reduce the volume of the adjustable container carrying strap structure 1 and facilitate the carrying.

Figure 8:
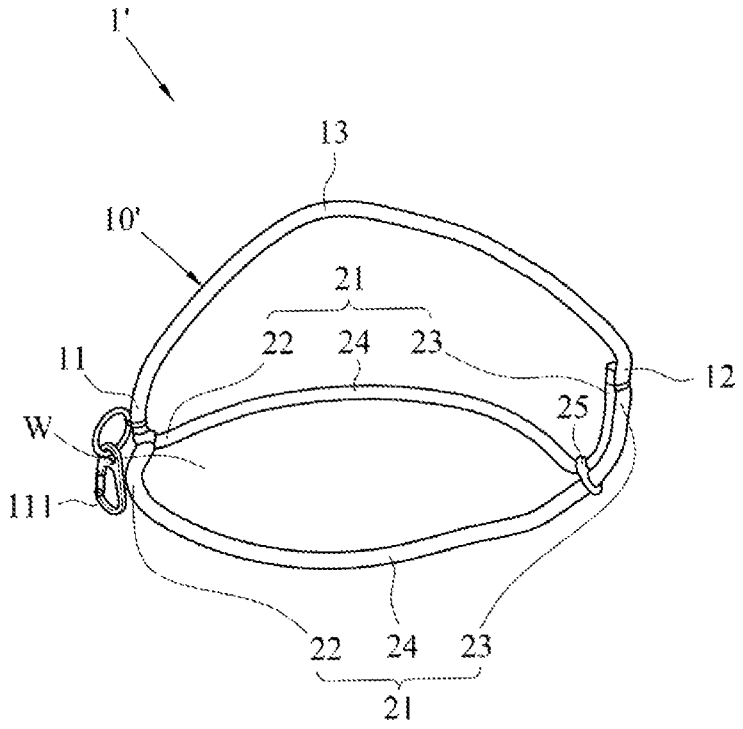
FIG. 8 illustrates a three-dimensional diagram of still another embodiment of the adjustable container carrying strap structure of the instant disclosure.

FIG. 8 is a three-dimensional diagram of still another embodiment of the adjustable container carrying strap structure. In this embodiment, the strip-shaped carrying strap 10' of the adjustable container carrying strap structure 1' is a rope body. For example, the strip-shaped carrying strap 10' and the two sleeve ropes 21 can be assembled on the adjusting element 25 (a rope buckle herein) by means of a rope body so as to be integrally formed. However, this embodiment is not limited thereto. The strip-shaped carrying strap 10' and the two sleeve ropes 21 can also be independently arranged. The first rope end 22 and the second rope end 23 of each sleeve rope 21 can be connected to the first end 11 and the second end 12 of the strip-shaped carrying strap 10' respectively in manners of sticking, knotting, suturing, binding, hot melting and the like or by using a fastener. For example, in this embodiment, the first rope end 22 of each sleeve rope 21 is fixed at the first end 11 of the strip-shaped carrying strap 10' by means of a fastener, and the second rope end 23 of each sleeve rope 21 is fixed at the second end 12 of the strip-shaped carrying strap 10' by means of a fastener. The adjusting element 25 is assembled on the two rope bodies 24 of the two sleeve ropes 21 and can slide relatively along the two rope bodies 24 so as to adjust the size of the container sleeving hole W to adapt to containers 2 with different sizes. In addition, one end (the first end 11 herein, but not limited thereto) of the strip-shaped carrying strap 10' can also be provided with a hanger 111 so as to increase the carrying convenience.

Figure 9:
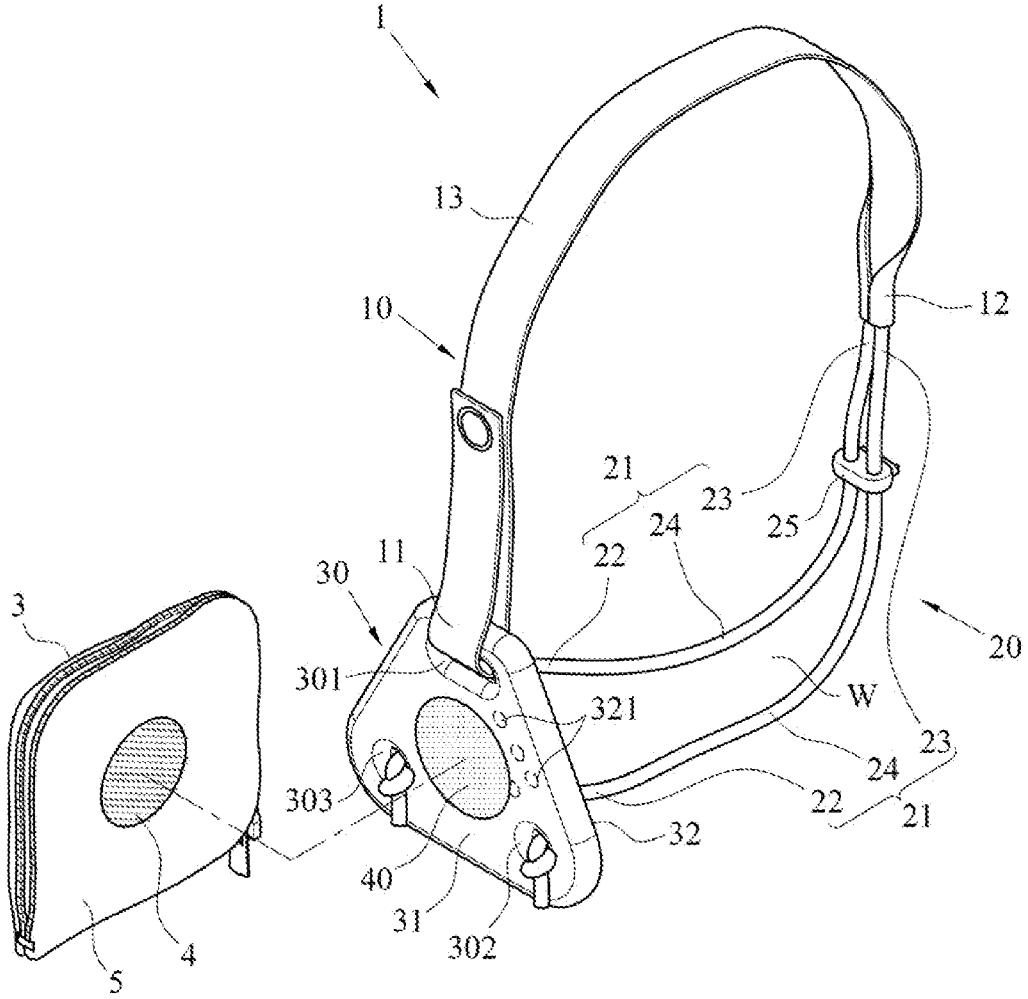
FIG. 9 illustrates a three-dimensional exploded diagram of another embodiment of the adjustable container carrying strap structure of the instant disclosure.

FIG. 9 is a three-dimensional exploded diagram of another embodiment of the adjustable container carrying strap structure of the instant disclosure. The difference between this embodiment and the embodiments of FIG. 1 to FIG. 4 is that the structures of reinforcing elements are different. In the embodiments of FIG. 1 to FIG. 4, the reinforcing element 14 is extending from the first end 11 of the strip-shaped carrying strap 10. In this embodiment, the reinforcing element 30 is an independent component and is assembled at the first end 11 of the strip-shaped carrying strap 10. For example, the reinforcing element 30 can be a hard plate or block which is manufactured additionally. Herein, the reinforcing element 30 is provided with a plurality of assembly portions (a first assembly portion 301, a second assembly portion 302, and a third assembly portion 303 herein) for respectively assembling the first end 11 of the strip-shaped carrying strap 10 and the two first rope ends 22 of the two sleeve ropes 21. In this embodiment, the first assembly portion 301, the second assembly portion 302, and the third assembly portion 303 are holes formed in different positions but are not limited thereto. The first end 11 of the strip-shaped carrying strap 10 and the two first rope ends 22 of the two sleeve ropes 21 are respectively fixed to the first assembly portion 301, the second assembly portion 302, and the third assembly portion 303 in a penetrating manner, so that the two first rope ends 22 of the two sleeve ropes 21 are indirectly connected to the first end 11 of the strip-shaped carrying strap 10 by means of the reinforcing element 30.

As shown in FIG. 9, the reinforcing element 30 is further provided with an outer surface 31 and an inner surface 32 which are opposite. The inner surface 32 faces the container sleeving hole W, and the outer surface 31 of the reinforcing element 30 is provided with a storage bag assembly part 40 for assembling and fixing a storage bag 3. When the adjustable container carrying strap structure 1 does not need to be used, the adjustable container carrying strap structure 1 can be contained in the storage bag 3, so that the adjustable container carrying strap structure 1 can be conveniently carried about, and other articles are prevented from being wound in the carrying process. Herein, the storage bag 3 is provided with a fixing element 4 which is correspondingly assembled and fixed on the storage bag assembly part 40. In this embodiment, the fixing element 4 of the storage bag 3 and the storage bag assembly part 40 are bonded and assembled to each other by means of corresponding male and female adhesive fasteners. In addition, as shown in FIG. 9, in some embodiments, the fixing element 4 can be arranged on the inner surface 5 of the storage bag 3. During use, the storage bag 3 can be turned over and the inner surface 5 is exposed, so that the storage bag 3 can be assembled and fixed on the storage bag assembly part 40 by means of the fixing element 4 on the inner surface 5. Therefore, when the adjustable container carrying strap structure 1 does not need to be used, the strip-shaped carrying strap 10 and the container sleeving assembly 20 can be directly contained in the storage bag 3, and the storage bag 3 does not need to be detached from the storage bag assembly part 40 so as to increase the convenience in use.

However, the above embodiments are only examples. The fixing element 4 of the storage bag 3 and the storage bag assembly part 40 can also be other corresponding assembly structures. For example, the fixing element 4 and the storage bag assembly part 40 can be corresponding magnetic suction parts or fastening parts. In addition, in some embodiments, the storage bag assembly part 40 can also be arranged on other parts of the adjustable container carrying strap structure 1. For example, the storage bag assembly part 40 can also be arranged on the strip-shaped carrying strap 10.

As shown in FIG. 9, in some embodiments, the inner surface 32 of the reinforcing element 30 is provided with an anti-slide structure 321. For example, the anti-slide structure 321 can be a plurality of suckers, an anti-slide pad, anti-slide rubber or the like and is not limited thereto. Therefore, when the two rope bodies 24 of the two sleeve ropes 21 are fastened around the container 2 (as shown in FIG. 3), the anti-slide structure 321 can be in contact with the surface of the container 2 to increase the adhesive force so as to prevent the adjustable container carrying strap structure 1 from easily moving or upwards separating.

Thereby, according to the adjustable container carrying strap structure of the embodiments of the instant disclosure, the adjusting element can slide relatively along the two rope bodies to enable the container sleeving hole to be sleeved on containers with different sizes and fastened between the two rope bodies, so that the container can be carried by means of the carrying strap body, thereby achieving the advantages of reducing the use of shopping bags, further realizing environmental protection, saving resources and the like. In addition, the two sleeve ropes are connected between the ends of the strip-shaped carrying strap to form a ring, so that no matter which size of a container the adjustable container carrying strap structure is used for, when the container is carried, the container can be kept upright and not inclined so as to effectively prevent articles contained inside the container from dumping or being poured out.

Although the instant disclosure has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An adjustable container carrying strap structure, comprising:

a strip-shaped carrying strap, comprising a first end and a second end which are opposite and a carrying strap body between the first end and the second end; and a container sleeving assembly, comprising two sleeve ropes and an adjusting element, wherein each sleeve rope comprises a first rope end and a second rope end which are opposite and a rope body between the first rope end and the second rope end, the first rope end of each sleeve rope is connected to the first end of the strip-shaped carrying strap, the second rope end of each sleeve rope is connected to the second end of the strip-shaped carrying strap, and the adjusting element is assembled on the two rope bodies, so that the adjusting element, the two rope bodies, and the first end of the strip-shaped carrying strap encircle a container sleeving hole, wherein the adjusting element can selectively slide relatively along the two rope bodies so as to adjust a size of the container sleeving hole, and wherein the adjusting element is a rope buckle or a movable fastener.

2. The adjustable container carrying strap structure according to claim 1, wherein the first end of the strip-shaped carrying strap is further provided with two through holes, the two first rope ends of the two sleeve ropes respectively penetrate through the two through holes, each first rope end of each sleeve rope is provided with a stopping element, and the stopping element is greater than each through hole.

3. The adjustable container carrying strap structure according to claim 2, wherein the stopping element is a rope knot.

4. The adjustable container carrying strap structure according to claim 1, wherein the first end of the strip-shaped carrying strap is further provided with two through holes, the two first rope ends of the two sleeve ropes respectively penetrate through the two through holes, and the two first rope ends are integrally connected.

5. The adjustable container carrying strap structure according to claim 1, wherein the first end of the strip-shaped carrying strap is further provided with a reinforcing element.

6. The adjustable container carrying strap structure according to claim 5, wherein an inner side of the reinforcing element is further provided with an anti-slide structure.

7. The adjustable container carrying strap structure according to claim 5, wherein the reinforcing element comprises two strap-shaped bodies, and the two strap-shaped bodies respectively extend from two opposite sides of the first end of the strip-shaped carrying strap.

8. The adjustable container carrying strap structure according to claim 7, wherein the two first rope ends of the two sleeve ropes are respectively connected to the two strap-shaped bodies.

9. The adjustable container carrying strap structure according to claim 1, wherein the first rope end and the second rope end of each sleeve rope are detachably connected to the first end and the second end of the strip-shaped carrying strap respectively.

10. The adjustable container carrying strap structure according to claim 1, wherein one side of the carrying strap body of the strip-shaped carrying strap is provided with a first assembly part, the first end of the strip-shaped carrying strap is provided with a second assembly part, and the first assembly part can selectively move to be close to the second assembly part and is assembled on the second assembly part.

11. The adjustable container carrying strap structure according to claim 10, wherein the first assembly part is adjacent to the first end.

12. The adjustable container carrying strap structure according to claim 1, wherein the first end or the second end of the strip-shaped carrying strap is further provided with a hanger.

13. The adjustable container carrying strap structure according to claim 1, wherein a length of each sleeve rope is less than a length of the strip-shaped carrying strap.

14. The adjustable container carrying strap structure according to claim 1, wherein the strip-shaped carrying strap is further connected with a storage bag assembly part.

15. The adjustable container carrying strap structure according to claim 14, wherein the storage bag assembly part is an adhesive fastener, a magnetic suction part, or a fastening part.

* * * * *